US006499544B1

(12) United States Patent
Shofner

(10) Patent No.: US 6,499,544 B1
(45) Date of Patent: Dec. 31, 2002

(54) PERCUSSIVE DOWN-THE-HOLE HAMMER FOR ROCK DRILLING, AND A ONE-WAY VALVE USED THEREIN

(75) Inventor: Matthew F. Shofner, Alachua, FL (US)

(73) Assignee: Sandvik AB, Sandviken (SE)

( * ) Notice: Subject to any disclaimer, the term of this patent is extended or adjusted under 35 U.S.C. 154(b) by 34 days.

(21) Appl. No.: 09/711,938

(22) Filed: Nov. 15, 2000

(51) Int. Cl.[7] ..... E21B 4/06
(52) U.S. Cl. ..... 173/91; 173/135; 173/136
(58) Field of Search ..... 173/15, 17, 73, 173/78, 80, 91, 135, 136; 175/296

(56) References Cited

U.S. PATENT DOCUMENTS

| | | | | | |
|---|---|---|---|---|---|
| 3,084,673 | A | * | 4/1963 | Sears | 173/136 |
| 3,964,551 | A | * | 6/1976 | Bassinger | 173/136 |
| 3,978,931 | A | * | 9/1976 | Sudnishnikov et al. | 173/110 |
| 4,133,393 | A | * | 1/1979 | Richards | 173/17 |
| 4,530,407 | A | * | 7/1985 | Rear | 173/137 |
| 4,903,785 | A | * | 2/1990 | Odoni et al. | 173/131 |
| 5,488,998 | A | * | 2/1996 | Ekwall et al. | 173/132 |
| 5,564,510 | A | * | 10/1996 | Walter | 173/73 |
| 5,715,897 | A | * | 2/1998 | Gustafsson | 173/17 |
| 5,915,483 | A | * | 6/1999 | Gien | 173/91 |
| 5,984,021 | A | * | 11/1999 | Pascale | 173/115 |
| 6,062,322 | A | | 5/2000 | Beccu et al. | 173/91 |
| 6,131,672 | A | | 10/2000 | Beccu et al. | 173/91 |

FOREIGN PATENT DOCUMENTS

| | | |
|---|---|---|
| WO | WO99/64711 | 12/1999 |

* cited by examiner

*Primary Examiner*—Scott A. Smith
*Assistant Examiner*—Nathaniel Chukwurah
(74) *Attorney, Agent, or Firm*—Burns, Doane, Swecker & Mathis, LLP

(57) ABSTRACT

A down-the-hole percussive hammer includes a casing, a drill bit attached to a lower end of the casing, and a reciprocable hammer for impacting against the drill bit. A top sub attached to an upper end of the casing includes a central passage for conducting operating air for actuating the piston. A feed tube is attached to the top sub and extends along a center axis thereof. The feed tube includes vertically spaced outlet and re-entry ports sealed from one another by a seal disposed inside of the feed tube. The outlet and re-entry ports communicate with a chamber formed in the central passage. A check valve is disposed at an upper end of the feed tube. The check valve includes an elastic sleeve arranged to overlie the outlet port and to be elastically biased away from the outlet port by pressurized operating air, whereupon the operating air passes out of the feed tube through the outlet port and then back into the feed tube through the re-entry port.

10 Claims, 7 Drawing Sheets

PERCUSSIVE DOWN-THE-HOLE HAMMER FOR ROCK DRILLING, AND A ONE-WAY VALVE USED THEREIN

TECHNICAL BACKGROUND

The present invention relates to a percussive down-the-hole hammer for rock drilling, and a one-way valve used therein.

DESCRIPTION OF THE PRIOR ART

A prior art drill bit for a down-the-hole hammer is disclosed in U.S. Pat. No. 6,062,322. The drill bit comprises an extended anvil portion on which a piston impacts repeatedly to advance the down-the-hole hammer through the rock. The piston is actuated by pressurized air that is conducted along a longitudinal central passage of the apparatus. That passage extends within a center of the piston and then is distributed alternately to upper and lower ends of the piston to reciprocate the piston.

It is necessary to provide a check valve in such a hammer in order to prevent the backflow of groundwater or debris during periods when the operating air is shut off. A conventional check valve, disclosed in U.S. Pat. No. 6,062,322, comprises a dart that is disposed within the central longitudinal passage and is biased upwardly against a seat by a metal coil spring. When the operating air is turned on, the air pressure pushes the open by compressing the spring. When the operating air is turned off, the spring pushes the dart closed. One disadvantage of such an arrangement is that the spring is susceptible to fatigue and corrosion and may eventually fail.

In WO 99/64711 a check valve is disclosed which comprises a rubber cylinder mounted on the outer circumference of the top sub (or "backhead"). A shortcoming of such an arrangement is that the top sub is a wear item and occasionally needs to be replaced, requiring that the valve be replaced as well. Also, the air passing through the valve must be displace along the inside wall of the cylinder which complicates the delivery of the air as compared to an apparatus in which the air is conducted through a central passage of the hammer.

OBJECTS OF THE INVENTION

It would, therefore, be desirable to provide a down-the-hole percussive hammer wherein a check valve does not have to be replaced along with the top sub, and wherein operating air can be conducted along a central longitudinal passage upon exiting the top sub.

SUMMARY OF THE INVENTION

A first aspect of the present invention relates to a down-the-hole percussive hammer for rock drilling. The hammer comprises a generally cylindrical casing, and a drill bit disposed at a front end of the casing. A piston is mounted longitudinally behind the drill bit in the casing for reciprocation in a longitudinal direction for applying impacts to the drill bit during each forward stroke of the piston. A top sub is mounted in a rear portion of the casing and includes a central passage for supplying operating air for reciprocating the piston. The central passage includes a chamber disposed between front and rear ends of the top sub. A hollow feed tube is mounted within the central passage, with a segment of the feed tube disposed within the chamber. The segment includes longitudinally spaced air outlet and re-entry ports communicating with the chamber. The outlet port is disposed rearwardly of the re-entry port. A seal is disposed within the feed tube for sealing an interior of the feed tube between the outlet and re-entry ports. A check valve is provided for permitting a forward flow of operating fluid and preventing a rearward flow of fluid. The valve includes an elastically resilient sleeve extending around an outer circumference of the feed tube for blocking the outlet port from the chamber. The sleeve is elastically expandible away from the outlet port by pressurized operating air to open the outlet port and permit operating air to flow out of the outlet port and into the chamber and then into the re-entry port.

The invention also pertains to the feed tube per se.

DESCRIPTION OF THE DRAWINGS

These and other objects of the present invention will become apparent from the following detailed description of preferred embodiments thereof in connection with the accompanying drawings, wherein.

DETAILED DESCRIPTION OF A PREFERRED EMBODIMENT OF THE INVENTION

Figure 1A:
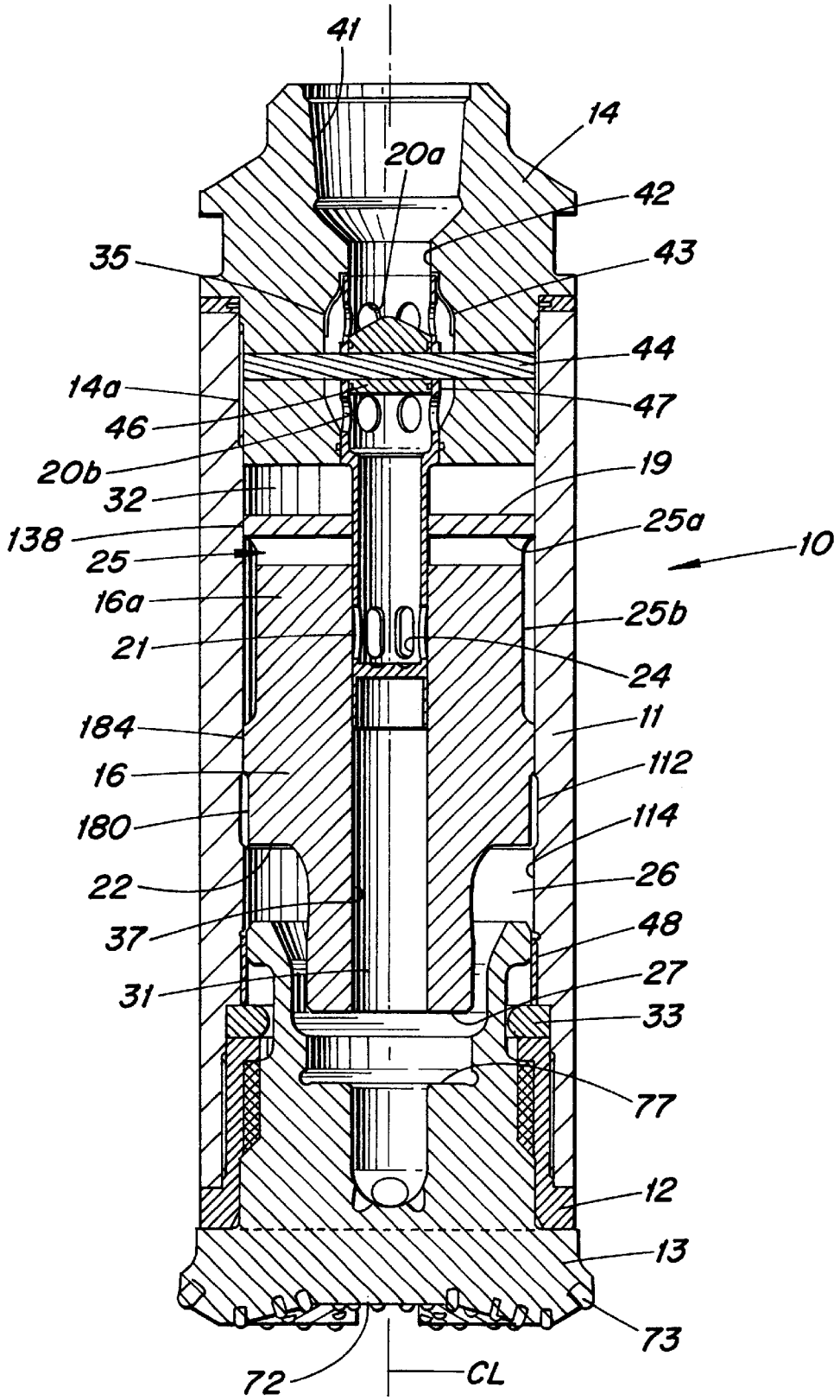
FIGS. 1A, 1B, 1C and 1D show a down-the-hole hammer according to the present invention in a longitudinal section in first, second, third and fourth positions, respectively.

In FIGS. 1A, 1B, 1C and 1D there is shown a preferred embodiment of a down-the-hole hammer 10 according to the present invention. The hammer 10 comprises a reversible outer cylindrical casing 11 which, via a top sub 14, is connectable to a rotatable drill pipe string, not shown, through which compressed air is conducted. The top sub has an external screw thread 14*a* connected to the casing 11. The inner wall of the casing 11 is almost free from air passage-defining grooves and is thus strong and relatively simple to manufacture. A hammer piston 16 reciprocates in the cylindrical casing 11, and compressed working air is directed alternately to the upper and lower ends of the piston to effect its reciprocation in the casing. Each downward stroke of the piston inflicts an impact blow upon a drill bit 13 mounted within a driver sub 12 at the lower portion of the cylindrical casing 11. The piston has a wide upper or rear portion 16*a* and a narrow lower or front portion 16*b*. The upper portion 16*a* slidably engages the inner wall of the casing 11.

Each of the portions 16*a* and 16*b* has a cylindrical basic shape and the lower, cylindrical portion 16*b* has a reduced diameter, thereby causing an intermediate end face or downwardly facing shoulder surface 22 to be formed on the upper portion 16*a*, which surface is preferably perpendicular to the center line CL of the hammer. The construction of the piston is based on the idea that the mass distribution of the piston 16 is such that when the piston impacts the drill bit, initially a relatively small mass, i.e., the portion 16*b*, is applied to the drill bit 13. Subsequently, the application of a larger mass, i.e., the portion 16*a*, follows. It has turned out that by such an arrangement, much of the kinetic energy of the piston is transmitted into the rock via the drill bit as discussed in U.S. Pat. No. 6,131,672, which is hereby incorporated by reference in the present description regarding the construction of the piston per se.

An inner cylindrical wall 37 of the piston defines a central passageway 31 and is arranged to slide upon a coaxial control tube or feed tube 15 that is fastened to the top sub 14. The feed tube 15 is hollow and includes radial air outlet ports 20*a* and radial air re-entry ports 20*b*, as will be discussed later in more detail.

The upper portion 16*a* of the piston is provided with several groups of passageways for the transportation of pressurized air. A first of those groups of passageways includes passageways 24 (see FIG. 1C), each of which includes a longitudinally extending portion 24*a* and a radially extending portion 24*b*. The longitudinally extending portion is spaced from an outer peripheral side surface 138 of the piston and communicates with the upper end face 19 of the piston. The radially extending portion 24*b* opens into the inner wall 37 of the piston at a location spaced longitudinally from the upper end face 19. Two second passageways 180 in the piston communicate with the shoulder 22 and are not spaced from the outer peripheral side surface 138 of the piston. Rather, a longitudinally extending recess formed in the outer peripheral side surface 138 of the piston defines each of the second passageways 180. Thus, there are two such recesses arranged diagonally opposite one another. An upper end of each recess is spaced downwardly from the upward end face 19. Each recess is formed by a secant extending through the outer side surface 138.

Two third passageways 25 are formed in the piston, each having a radially extending portion 25*a* and a longitudinally extending portion 25*b*. Each longitudinally extending portion 25*b* is defined by a groove formed in the outer side surface 138 of the piston. The lower end of the longitudinal portion 25*b* is spaced above an upper end of a respective second passage 180, whereby a radially outwardly projecting rib 184 is formed therebetween. The rib includes an outer face formed by the outer peripheral side surface 138 of the piston. The longitudinal portion 25*b* is situated above the rib 184 and is in longitudinal alignment with a respective one of the second passageways 180. Each radially extending portion 25*a* opens into the inner wall 37 of the piston and is situated above the radially extending portion 24*b* of the first passageway.

The casing 11 has an annular groove 112 formed in an inner surface 114 thereof. The groove 112 is arranged to become aligned with the rib 184 when the air outlet apertures 21 of the feed tube 15 are aligned with the third passageways 25 (see FIG. 1C), whereby air is able to flow around the rib 184 and reach the bottom chamber 26*b*.

Figure 2:
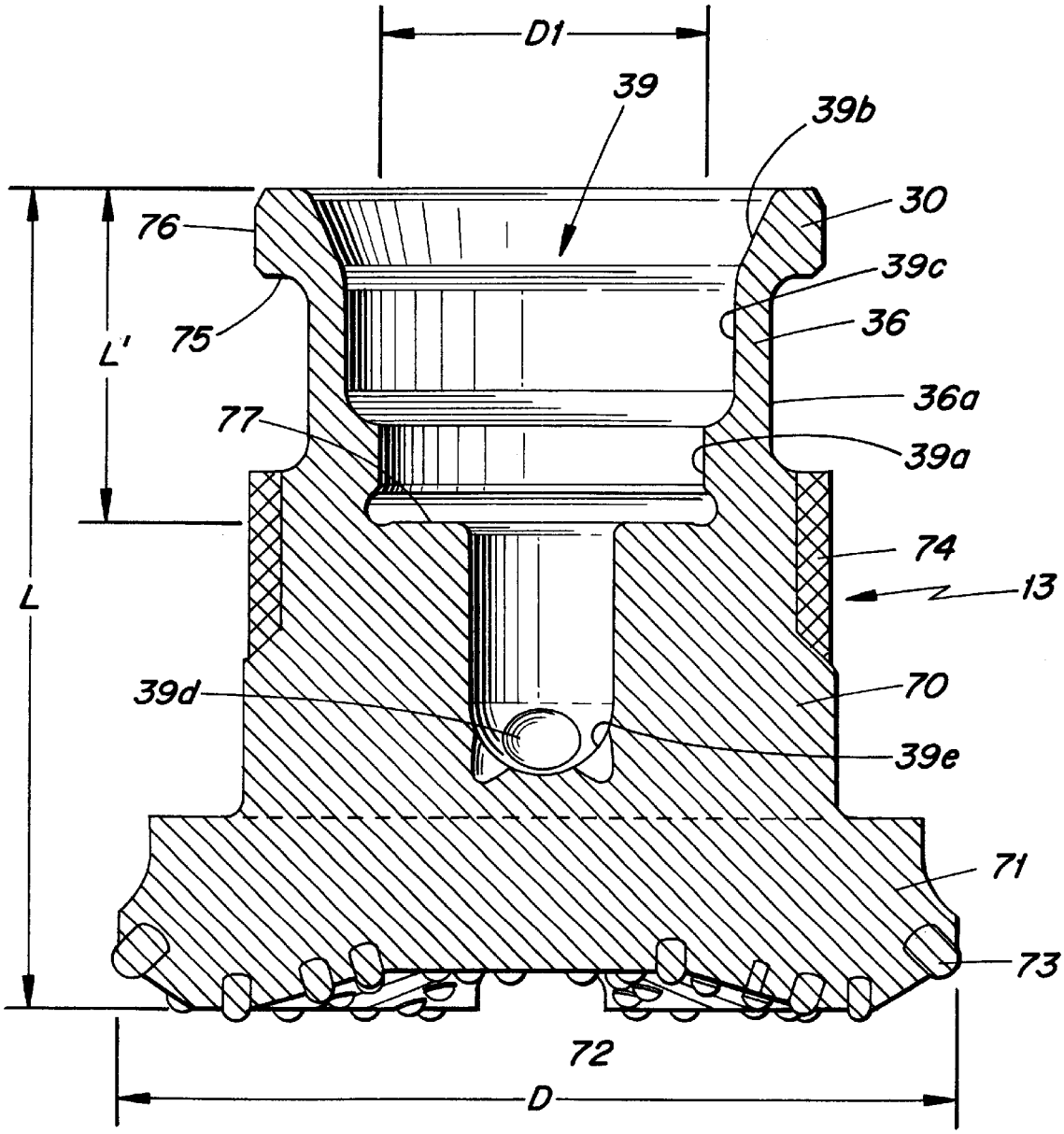
FIG. 2 shows a drill bit according to the present invention in a longitudinal section.
Figure 3:
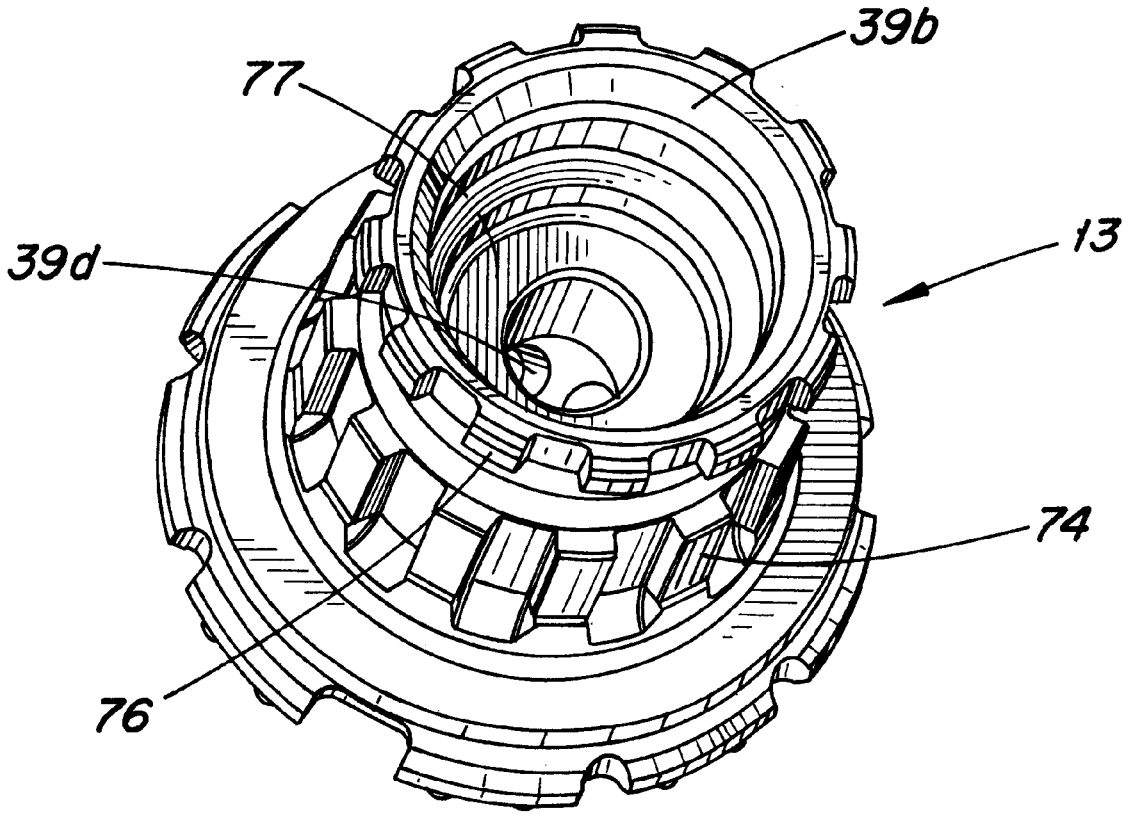
FIG. 3 is a top perspective view of the drill bit.

The drill bit 13 has a shank 70 and a head 71, see FIGS. 2 and 3. The head is provided with a front cutting surface 72 comprising numerous cemented carbide buttons 73. The shank 70 is provided with splines 74 at the mid portion thereof. The splines 74 are intersected by an annular groove 36*a* made for cooperation with radially inwardly projecting retainers 33 to retain the drill bit in the casing while allowing axial reciprocation therein. The retainers are sandwiched between the top of the bottom sub 12 and a downwardly facing shoulder 79 of the casing 11. A rear portion 30 of the drill bit protrudes radially relative to said groove 36*a* thereby forming a forwardly facing stop shoulder 75 and an annular notched jacket surface 76 (see FIG. 3).

A central passageway 39 is formed in the shank 70 to allow air to be transferred therethrough to outlet channels 39*d* (see FIG. 2), which are inclined downwardly at an acute angle relative to the center axis of the hammer to conduct air to the front cutting surface 72. The central passageway 39 comprises a downwardly tapering upper portion 39*b* connecting to a cylindrical portion 39*c* that in turn connects to a lower portion 39*a* of lesser diameter than the cylindrical portion. The lower portion 39*a* connects to a recess bottom 77 extending above a cavity having a concave floor 39*e*. The longitudinal length L of the drill bit is less than an outer diameter D of the front cutting surface. The recess bottom 77 is spaced from a rearwardmost end of the drill bit by a distance L' which should be greater than ten percent of the length L, but more preferably is greater than twenty percent of the length L, and most preferably is greater than thirty percent of the length L.

The recess bottom 77 defines an impact surface that is to be engaged by a front end 27 of the piston 16. An outer diameter D1 of the impact surface 77 equals the diameter of the passageway portion 39*a* and is at least twenty percent of the outer diameter D of the front cutting surface 72, more preferably at least thirty percent of the diameter D, and most preferably at least forty percent of the diameter D.

The recess bottom 77 defines an impact surface that is to be engaged by a front end 27 of the piston 16. The lower part of the lower portion 16*b* of the piston will constantly be situated within the central passageway 39 of the shank 70. The outer wall 40 of the lower portion 16*b* will slide against an inner wall of the lower portion 39*a* of the central passageway 39 to form a seal therebetween. The rear portion 30 of the drill bit 13 is disposed within a ring member 48 situated above the retainers 33.

A bottom chamber 26 is continuously formed between the piston 16 and the drill bit 13. During a downward stroke of the piston, the lower portion 16*b* of the piston reaches a position shown in FIG. 1B whereby the bottom recess 39*e* of the central passageway 39 is closed off. At that moment, the air outlet apertures 21 in the feed tube are also closed. Thus, the bottom chamber assumes a configuration 26*a* which is closed to the outside, whereupon the air in the bottom chamber begins to be compressed as the piston descends farther. Eventually, the piston strikes the drill bit 13 (see FIG. 1C), whereby the bottom chamber assumes a configuration 26*b*. It should be noted that the tapering upper portion 39*b* and the cylindrical portion 39*c* are of generally larger diameter than the lower portion 16*b* of the piston to form walls of said bottom chamber.

Figure 4:
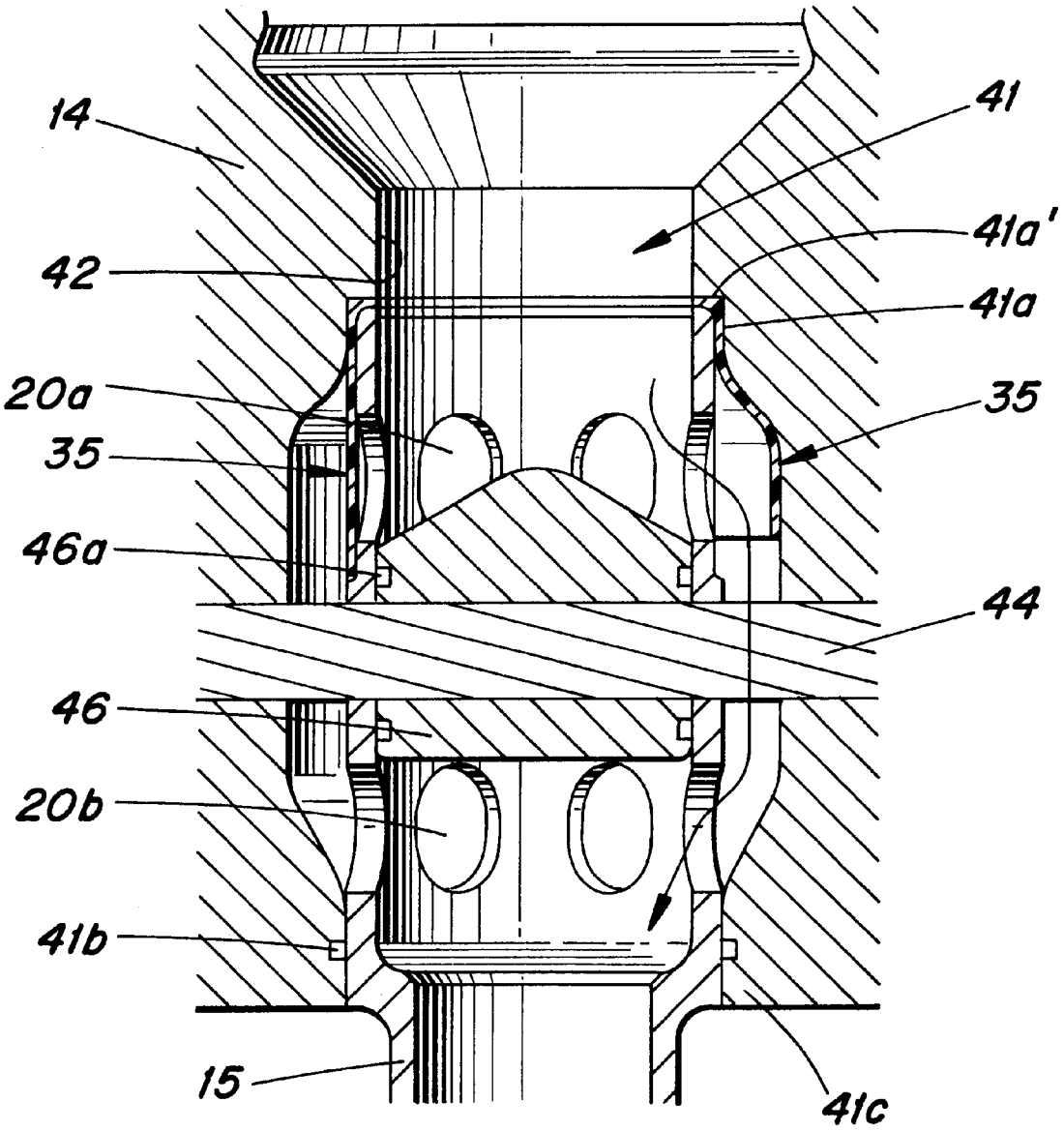
FIG. 4 is a fragmentary view of a check valve showing closed and open states thereof.

The pressurized air is constantly delivered to a central bore 41 of the top sub 14 while the hammer is in use. The bore 41 connects to a cylindrical restriction 42 that in turn connects to an expanded center cavity 43. The feed tube 15 extends into the center cavity 43. Disposed on the upper portion of the tube 15 is a check valve defined by a hollow rubber sleeve 35. An upper portion of the sleeve is sandwiched between the feed tube and a wall of the central bore. That is, a radially extending top lip of the sleeve opposes a downwardly facing surface 41*a'* of the central bore, and a side of the sleeve opposes a radially inwardly facing surface 41*a* of the central bore (see FIG. 4). A lower portion of the sleeve extends over the air outlet ports 20*a* to stop water or air from passing through the hammer the wrong way, i.e., in an upward direction through the feed tube. A central plug 46 disposed in the feed tube carries seal rings 46*a* and blocks direct travel of air from the outlet ports 20*a* to the re-entry ports 20*b*, requiring the air to flow into the cavity 43 in order to reach the re-entry ports 20*b*. Thus, when air is allowed to pass through the hammer the correct way, i.e., downwardly, the resilient sleeve 35 will expand elastically due to a pressure differential between the interior of the tube 15 and the cavity 43 to enable air to pass through the air outlet ports 20*a* (see the right-hand side of FIG. 4) into the surrounding cavity 43 and then back into the feed tube 15 through the air re-entry ports 20*b* arranged axially below the air outlet ports 20*a*. Ideally, the sleeve 35 opens only once during a drilling session, and closes during periods when the air supply is terminated. A portion of the feed tube extends through a seal ring 41*b* mounted in a reduced-diameter portion 41*c* of the center bore 41, to seal against the forward passage of air past the portion 41*b* along an outer surface of the feed tube.

The feed tube is mounted to the top sub by means of a lateral pin 44 extending diametrically all the way through the top sub 14, i.e., through aligned radial bores respectively formed in the lower threaded portion of the top sub, the central plug 46 and the upper portion 47 of the tube 15. The pin 44 thus secures the plug 46 within the feed tube.

The hammer functions as follows with reference to FIGS. 1A to 1C. FIG. 1C shows the impact position of the piston 16. The forward end 27 of the piston has just impacted on the recess bottom 77 of the bit 13. A shock wave will be transferred through the bit forwardly from the recess bottom 77 to the cemented carbide buttons at the front surface of the bit, thereby crushing rock material. The steel material of the drill bit situated rearwardly of the recess bottom 77 will be subjected to tension such that the inertia thereof will prolong the application of force to the bottom 77 from the striking surface 27. Thus, a reflecting shock wave in the piston will not be large. The hammer is simultaneously rotated via the drill string, not shown.

The piston will then move upwardly due to rebound from the bit and due to the supply of pressurized air from the air outlet apertures 21 of the control tube 15 via the passageways 25 and 180 (see FIG. 1C). The piston will close the apertures 21 while moving upwardly such that no more pressurized air will be emitted through the apertures 21. Accordingly, the sleeve 35 will close, thereby closing the passage 41 (see FIG. 1B), since the airflow is blocked. The piston 16 is still moving upwardly due to its momentum and due to the expanding air in the bottom chamber. This piston movement will continue until the force acting downwardly upon the top surface 19 of the piston becomes greater than the force acting upwardly on the intermediate end face 22 of the piston. In the meantime, neither the top chamber 32 nor the bottom chamber 26*a* communicates with the supply of air or the outlet channels (see FIG. 1B).

Figure 1B:
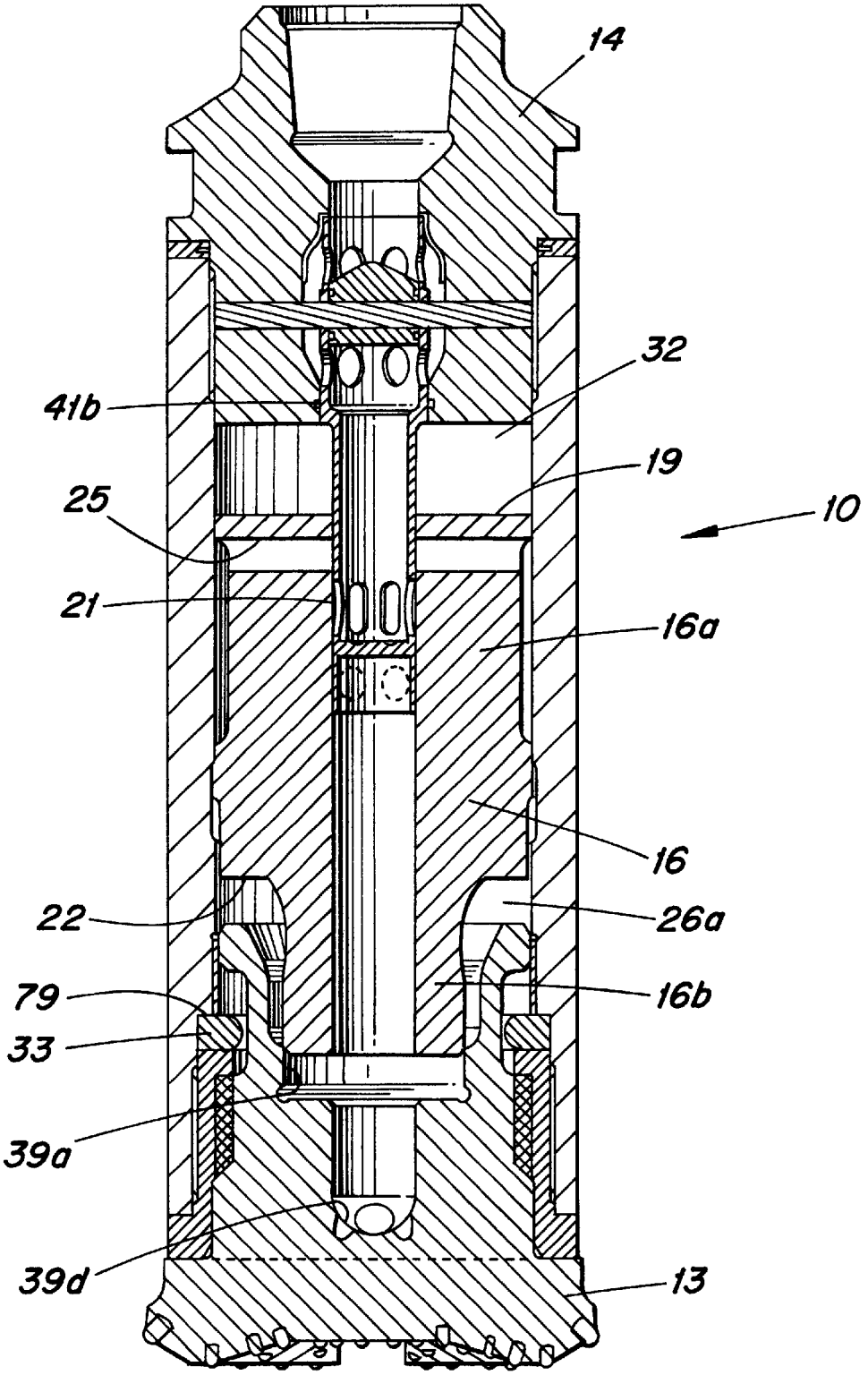
Figure 1C:
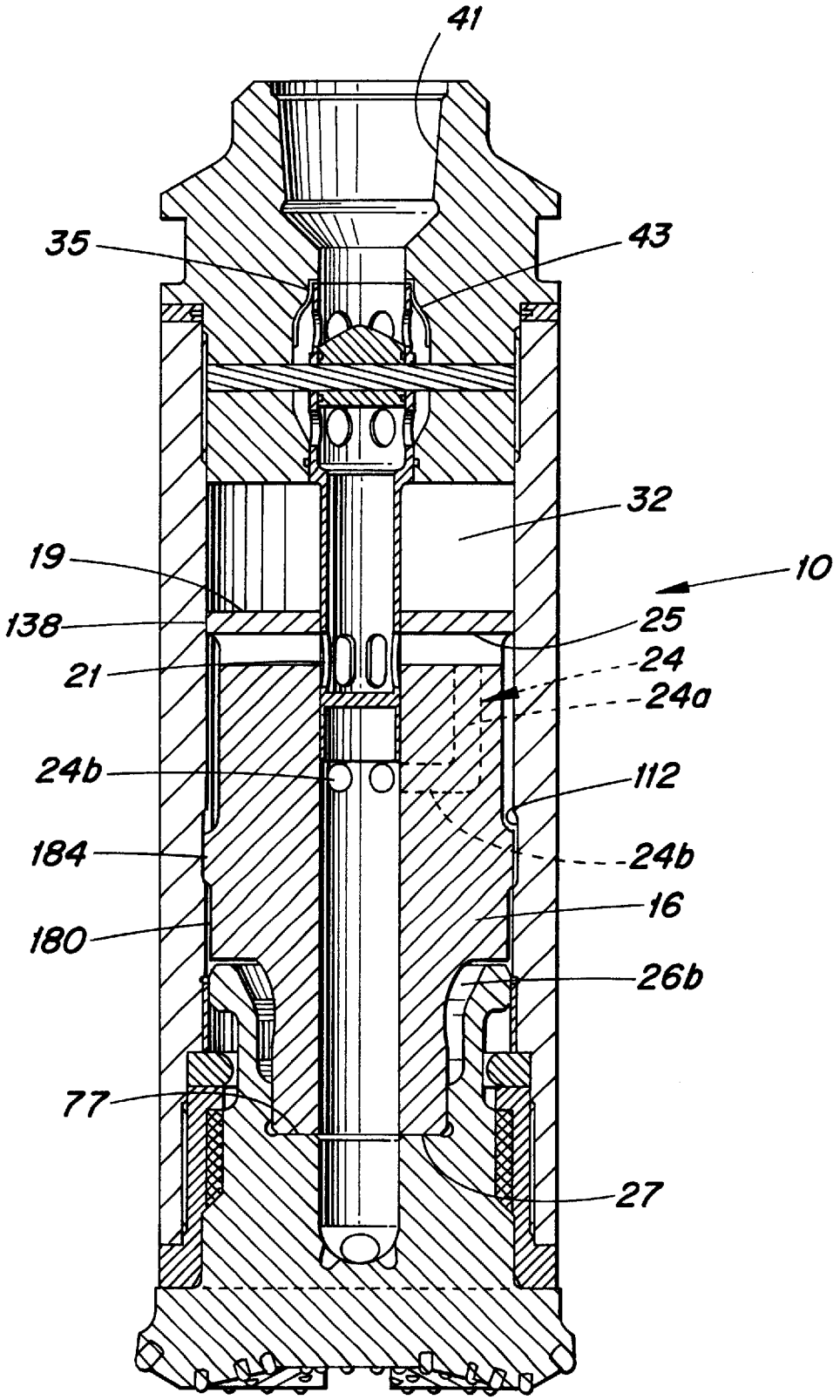

In the position shown in FIG. 1A the bottom chamber 26 has been opened to the exterior since the inner wall 39*a* of the drill bit 13 and the outer wall 40 of the lower portion 16*b* of the piston no longer engage one another. Thus, the air will rush from the bottom chamber through the drill bit 13 for blowing away drill dust. The top chamber 32 is now supplied by pressurized air via the apertures 21 and the passageway 24*a*, 24*b*. The piston, however, is still moving upwardly such that eventually the apertures 21 become closed from the passageway 24*a*, 24*b* while the pressure of the compressed air in the closed top chamber 32 is boosted to a level about equal to the pressure of the supply air being delivered to the control tube 15. At this stage the piston stops its upward movement. A downward movement is then started due to the spring force of the compacted air in the closed top chamber 32. The downward movement is accelerated by air pressure added by the opening of the air supply to the top chamber 32 when the apertures 21 become aligned with passageways 24*a* , 24*b*. The piston will continue its downward movement until the surface 27 of the elongated lower portion 16*b* impacts on the bit 13 as shown in FIG. 1C.

Figure 1D:
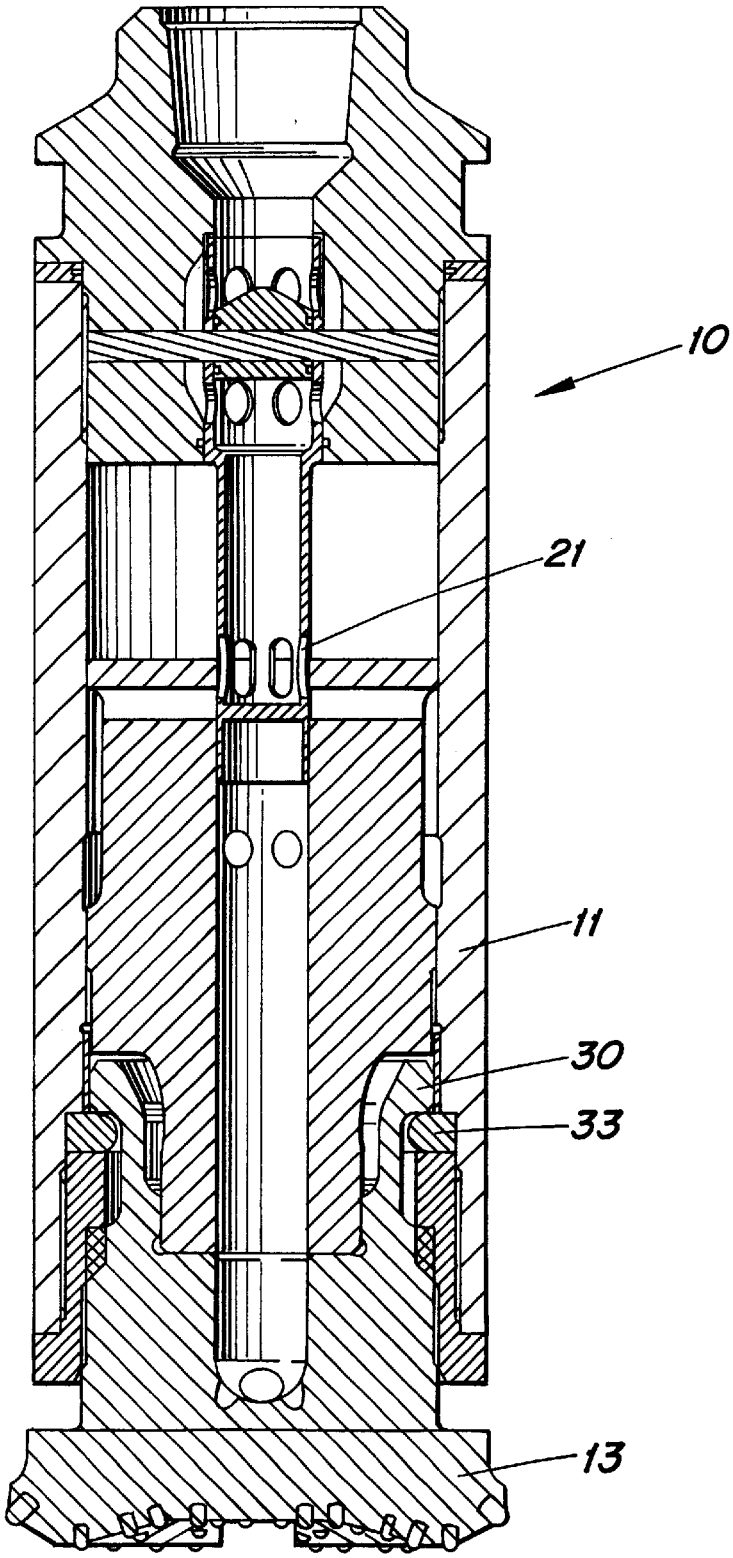

The above-described cycle will continue as long as the pressurized air is supplied to the hammer or until the anvil portion 30 of the drill bit comes to rest on the bit retainers 33 as shown in FIG. 1D. The latter case can occur when the bit encounters a void in the rock or when the hammer is lifted. Then, to avoid impacts on the retainers 33, the supply of air will not move the piston but will rather exit through the apertures 21 and to the front exterior of the hammer. However, when the hammer again contacts rock, the bit 13 will be pushed into the hammer to the position of FIG. 1C and drilling is resumed provided that pressurized air is supplied.

Further in accordance with the present invention the design of the drill bit provides a weight saving of about 200 kg on a 20" diameter hammer since the hammer can be made shorter and a bit-mounting structure can be avoided. The drill bit, that is the prime wear part of the hammer, can be made about 100 kg lighter for a 20" hammer. Such a hammer in accordance with the present invention with an "internal" impact can still be very efficient, about 90%.

It will be appreciated that the sleeve 35, which prevents a backflow of fluid and debris, does not have to be replaced when the top sub has to be replaced. Also, all of the operating air can be displaced through the center bore 41 of the top sub.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A down-the-hole percussive hammer for rock drilling, comprising:

a generally cylindrical casing defining a longitudinal center axis;

a drill bit disposed at a front end of the casing;

a piston mounted longitudinally behind the drill bit in the casing for reciprocation in a longitudinal direction for applying an impact to the drill bit during each forward stroke of the piston;

a top sub mounted in a rear portion of the casing and including a central passage for supplying operating air for reciprocating the piston, the central passage including a chamber disposed between front and rear ends of the top sub;

a hollow feed tube mounted within the central passage and including a segment disposed within the chamber, the segment including longitudinally spaced air outlet and re-entry ports communicating with the chamber, the outlet port disposed rearwardly of the re-entry port;

a seal disposed within the feed tube for sealing an interior of the feed tube between the outlet and re-entry ports, the seal being mounted against longitudinal movement relative to the feed tube; and a check valve for permitting a forward flow of operating air and preventing a rearward flow of fluid, the valve including an elastically resilient sleeve extending around an outer circumference of the feed tube for blocking the outlet port from the chamber, the sleeve being elastically expandible away from the outlet port by pressurized operating air to open the outlet port and permit operating air to flow out of the outlet port and into the chamber and then into the re-entry port.

2. The percussive hammer according to claim 1 wherein the feed tube is attached to the top sub by a pin extending radially through the top sub and the feed tube.

3. The percussive hammer according to claim 2 wherein the seal is carried by the pin.

4. The percussive hammer according to claim 3 wherein the pin passes through the seal.

5. The percussive hammer according to claim 1 wherein a portion of the sleeve is sandwiched between a top end of the feed tube and a wall of the central passage.

6. The percussive hammer according to claim 1 wherein the feed tube is disposed within the piston which is longitudinally reciprocable relative to the feed tube.

7. A feed tube assembly adapted to be mounted in a down-the-hole percussive hammer for conducting operating air to a piston, the feed tube assembly comprising:

a hollow feed tube defining a longitudinal center axis and including longitudinally spaced air outlet and re-entry ports, the outlet port disposed rearwardly of the re-entry port;

a seal disposed within the feed tube for sealing an interior of the feed tube between the outlet and re-entry ports, the seal being mounted against longitudinal movement relative to the feed tube; and a check valve for permitting a forward flow of operating air and preventing a rearward flow of fluid, the valve including an elastically resilient sleeve extending around an outer circumference of the feed tube for blocking the outlet port from an exterior of the feed tube, the sleeve being elastically expandible away from the outlet port by pressurized operating air to open the outlet port and permit operating air to flow out of the outlet port and into the re-entry port.

8. The feed tube assembly according to claim 7 wherein the seal is attached to the feed tube by a pin extending radially through the feed tube and the seal.

9. A down-the-hole percussive hammer for rock drilling, comprising:

a generally cylindrical casing;

a drill bit disposed at a front end of the casing;

a piston mounted longitudinally behind the drill bit in the casing for reciprocation in a longitudinal direction for applying an impact to the drill bit during each forward stroke of the piston;

a top sub mounted in a rear portion of the casing and including a central passage for supplying operating air for reciprocating the piston, the central passage including a chamber disposed between front and rear ends of the top sub;

a hollow feed tube mounted within the central passage and including a segment disposed within the chamber, the segment including longitudinally spaced air outlet and re-entry ports communicating with the chamber, the outlet port disposed rearwardly of the re-entry port;

a seal disposed within the feed tube for sealing an interior of the feed tube between the outlet and re-entry ports; and a check valve for permitting a forward flow of operating air and preventing a rearward flow of fluid, the valve including an elastically resilient sleeve extending around an outer circumference of the feed tube for blocking the outlet port from the chamber, the sleeve being elastically expandible away from the outlet port by pressurized operating air to open the outlet port and permit operating air to flow out of the outlet port and into the chamber and then into the re-entry port;

wherein the feed tube is attached to the top sub by a pin extending radially through the top sub and the feed tube and passing through the seal.

10. A feed tube assembly adapted to be mounted in a down-the-hole percussive hammer for conducting operating air to a piston, the feed tube assembly comprising:

a hollow feed tube including longitudinally spaced air outlet and re-entry ports, the outlet port disposed rearwardly of the re-entry port;

a seal disposed within the feed tube for sealing an interior of the feed tube between the outlet and re-entry ports, the seal being attached to the feed tube by a pin extending radially through the feed tube and the seal; and a check valve for permitting a forward flow of operating air and preventing a rearward flow of fluid, the valve including an elastically resilient sleeve extending around an outer circumference of the feed tube for blocking the outlet port from an exterior of the feed tube, the sleeve being elastically expandible away from the outlet port by pressurized operating air to open the outlet port and permit operating air to flow out of the outlet port and into the re-entry port.

* * * * *